US005650065A

United States Patent [19]

Sewell

[11] Patent Number: 5,650,065

[45] Date of Patent: Jul. 22, 1997

[54] SKIMMER COVER FOR DRY WELL IN A CATCH BASIN

[76] Inventor: William J. Sewell, Rte. 2, Box 57G, Pomeroy, Wash. 99347

[21] Appl. No.: 589,380

[22] Filed: Jan. 22, 1996

[51] Int. Cl.[6] ..... E03F 5/00

[52] U.S. Cl. ..... 210/166; 210/170; 210/163; 52/12; 52/20; 52/169.6; 404/4

[58] Field of Search ..... 210/163, 164, 210/165, 166, 170; 52/11, 12, 19, 20, 169.5, 169.6; 404/4; 405/36

[56] References Cited

U.S. PATENT DOCUMENTS

| | | | |
|---|---|---|---|
| D. 350,815 | 9/1994 | Florence | D23/260 |
| 527,580 | 10/1894 | Barret | 210/164 |
| 1,137,516 | 4/1915 | Moon . | |
| 1,195,827 | 8/1916 | Lucke | 210/163 |
| 1,407,397 | 2/1922 | Evans . | |
| 3,377,784 | 4/1968 | Walker | 210/166 |
| 3,378,858 | 4/1968 | Jacuzzi | 210/166 |
| 4,261,823 | 4/1981 | Gallagher et al. | 210/164 |
| 4,505,814 | 3/1985 | Marshall | 210/166 |
| 4,720,209 | 1/1988 | Isms | 405/36 |
| 5,028,320 | 7/1991 | Gaudin et al. | 210/164 |
| 5,062,735 | 11/1991 | Gaudin | 210/164 |
| 5,195,284 | 3/1993 | Florence | 52/109.5 |
| 5,469,670 | 11/1995 | Thaler | 210/166 |

FOREIGN PATENT DOCUMENTS

| | | |
|---|---|---|
| 100479 | 3/1915 | United Kingdom . |
| 623464 | 5/1949 | United Kingdom . |

*Primary Examiner*—Christopher Upton
*Attorney, Agent, or Firm*—Keith S. Bergman

[57] ABSTRACT

A skimmer cover for a secondary dispersement system orifice in a storm water catch basin prevents inflow of floatable materials, and especially hydrocarbons from motor vehicles, from entering the orifice. The orifice is defined in a neck extending spacedly above the bottom of the catch basin surface to carry the skimmer cover. The skimmer cover provides a top with a peripheral skirt diametrically larger than the neck and supported on the neck to depend therebelow to a point spacedly above the catch basin bottom surrounding the neck. An internal cylinder depends from the cover top within the skimmer cover skirt and defines plural spaced orifices to allow fluid passage therethrough and into the orifice defined by the neck. A depending fastening structure having opposed pivotal lever arms moved by a medial screw therebetween is carried by the skimmer cover top to allow releasable fastening of the skimmer cover within the neck orifice for positional establishment and maintenance of the skimmer cover thereon.

4 Claims, 2 Drawing Sheets

SKIMMER COVER FOR DRY WELL IN A CATCH BASIN

RELATED APPLICATIONS

There are no applications related hereto heretofore filed in this or any foreign country.

BACKGROUND OF INVENTION

1. Field of Invention

This invention relates generally to a skimmer cover for the neck of a secondary drainage system in a catch basin to prevent entry of floatable material including fluidic material into the neck.

2. Background and Description of Prior Art

Catch basins have long been used to aid the disposal of accumulations of runoff water from areas where the soil surface has been sealed by buildings, roadways, parking lots and the like that prevent direct earth absorption of the water. Such catch basins in their early developmental state were simplistic structures, generally defined by a peripheral berm which created a storage basin from which water directly permeated into the earth therebeneath over a period of time as conditions permitted. As land use became more concentrated and sophisticated, the size of catch basins decreased because of the economics involved and as this trend continued, the removal of water from catch basins came to be aided by the use of secondary drainage systems such as dry wells and storm sewers. With the increased use of such drainage facilities for areas that serviced substantial numbers of hydrocarbon fueled vehicles, such as parking lots, parking garages, roadways and the like, and the increase in societal concerns for environmental protection and pollution, new problems have arisen concerning such drainage facilities.

Generally in areas used for hydrocarbon fueled vehicles, there is a sufficient accumulation of hydrocarbons and their residues of various sorts to be of concern under present day environmental standards. These hydrocarbon materials often are carried into drainage systems, especially during storms or runoff periods that generate unusually high volumes of water, which in the traditional catch basin systems generally has been dispersed into the earth or into some type of a storm sewer system to ultimately be deposited in the earth environment.

This problem has been recognized in the past and a popular solution that has been developed to resolve it has been to create catch basins defined by berms to receive and retain the waste water. The water contacting surfaces of such catch basins are provided with a blanket of vegetation, commonly some type of ornamental grass, that is intended to catch and entrap fluidic hydrocarbon pollutants which supposedly are subsequently modified or changed in nature to alleviate the deleterious effects of such materials on the environment wherein they ultimately come to reside. This type of waste water disposal has become sufficiently popular and standardized that its use is required by various land use and planning statutes and ordinances, as well as by various administrative codes and engineering standards.

In such a system that is serviced by a secondary water disposal system such as a dry well or sewer input orifice to accommodate large volumes of runoff water, however, problems still exist that often allow passage of fluidic hydrocarbon materials or their residues into the secondary water disposal system of a catch basin. Normally if such secondary water disposal systems are provided their entry orifices are medially positioned in a catch basin that may have some substantial depth of water during high runoff periods, but such entry orifices generally by necessity project above the lower surface of the catch basin wherein they are located while. The catch basin, however, may allow storage of water at a substantially greater depth than the entry orifices so when a runoff occurs that results in a waste water level above the level of the entry orifice various floatable materials such as fluidic hydrocarbons and their residues may enter the secondary disposal system rather than remaining in the catch basin for natural degradation. My invention seeks to provide a skimmer cover for such entry orifices that prevents such happening and maintains fluidic and other floatable materials outside the entry orifices and within the associated catch basin.

Gravity separation of contaminant material in runoff water, whether that material be more or less dense than water, has heretofore been known and practiced. Most such separation has developed for sinkable materials such as silt, sand, pebbles and the like which, if they pass into a water disposal system and especially one of the dry well type, tend to plug that system and render it non-usable. Most systems that have removed floatables have been concerned with larger particulate debris such as various vegetative material. Some such systems have separated fluidic floatable material such as hydrocarbons, fats and greases, but generally those systems have captured that material in some type of a container that must be periodically emptied to maintain the operability of the system. Such systems generally have not been designed or adapted to deal with such material left in them. The instant apparatus differs from this prior art by providing a skimming cover that prevents entry of floatable material of either a fluidic or particulate nature into the orifice of a secondary disposal system, but yet maintains that material within the catch basin wherein it was entrapped for subsequent removal of solid material or transformation of floatable material according to normal management activity of the catch basin.

The instant skimmer cover to be practically usable on the orifice of a secondary water disposal system of a catch basin must be fastenably engageable within that orifice and positionally maintainable thereon for operation, while at the same time being removable to allow access to the system through the orifice. Covers heretofore known for such orifices have not provided simply operable positive fastening mechanism, but generally have relied upon the substantial mass of a cover to allow positional maintenance by means of gravity and have established proper positioning by use of particular joint structure, if at all. Covers that have provided positive fastening means generally have been complex and have provided fastening mechanism that may be easily tampered with by unauthorized users. The instant cover in contradistinction provides a simple but effective pivotally expandable arm structure that is operated by a medial threaded rod to cause fastening with proper concentric positioning in an orifice while not requiring interfitting joint structure or reconfiguration of the neck. The threaded rod may have a particularly shaped head to require use of a particular tool to cause its rotation to tend to avoid operation by unauthorized users.

My invention resides not in any one of these features individually, but rather in the synergistic combination of all of the structures of my skimmer cover that necessarily give rise to the functions flowing therefrom, as herein specified and claimed.

SUMMARY OF INVENTION

My invention provides a skimmer cover for a secondary water orifice defined by a neck that projects spacedly above the bottom of a catch basin to prevent floatable materials, either particulate or fluidic, from entering the orifice. The cover provides a top interconnecting a peripheral depending skirt similar in configuration and larger in size than the neck to be serviced so as to fit over that neck. Horizontal supports are carried in a vertically medial position within the skirt to support the cover on the neck, with the lower portion of the skirt spacedly below the orifice of the neck and spacedly above the surface defining the bottom of the catch basin serviced by the orifice. A depending cylinder similar in shape but smaller than the skirt extends from the cross supports to the cover top and defines a plurality of spaced orifices to allow water to pass therethrough to enter the orifice of the neck.

A fastening structure provides an elongate threaded rod rotatably supported by its head in a hole defined in the medial portion of the top to depend therefrom. The rod threadedly carries a first lower bracket pivotally supporting two diametrically opposed, upwardly angulated lower lever arms, each of greater length than half the diameter of the outlet orifice. A second upper bracket threadedly carried in a medial position on the rod, pivotally mounts two downwardly angulated diametrically opposed upper lever arms, each pivotally interconnected in its outer end with the medial portion of each of the lower pivot arms so that as the threaded rod is turned the lower arms responsively move toward or away from each other to contact the neck or to allow removal of the cover from the neck.

In providing such a device, it is:

A principal object to provide a skimmer cover for the upstanding neck of a secondary water disposal system in a catch basin to prevent entry of floatable materials, either fluidic or particulate, into the orifice of the neck and maintains such floatable materials within the catch basin notwithstanding the depth of water therein relative to the cover.

A further object is to provide such a skimmer cover that has mechanism to releasably fasten the cover in the neck for initial positioning and positional maintenance in an operative relationship with the neck while yet allowing simple and easy removal and fastening by manipulation of a threaded rod having a head that may be configured to aid in preventing unauthorized use.

A still further object is to provide such a skimmer cover that is of new and novel design, of rugged and durable nature, of simple and economic manufacture and otherwise well adapted to the uses and purposes for which it is intended.

Other and further objects of my invention will appear from the following specification and accompanying drawings which form a part hereof. In carrying out the objects of my invention, however, it is to be remembered that its accidental features are susceptible of change in design and structural arrangement, with only one preferred and practical embodiment of its best known mode being illustrated in the drawings and described in the specification as is required.

BRIEF DESCRIPTION OF DRAWINGS

In the accompanying drawings which form a part hereof and wherein like numbers of reference refer to similar parts throughout.

DESCRIPTION OF PREFERRED EMBODIMENT

Figure 1:
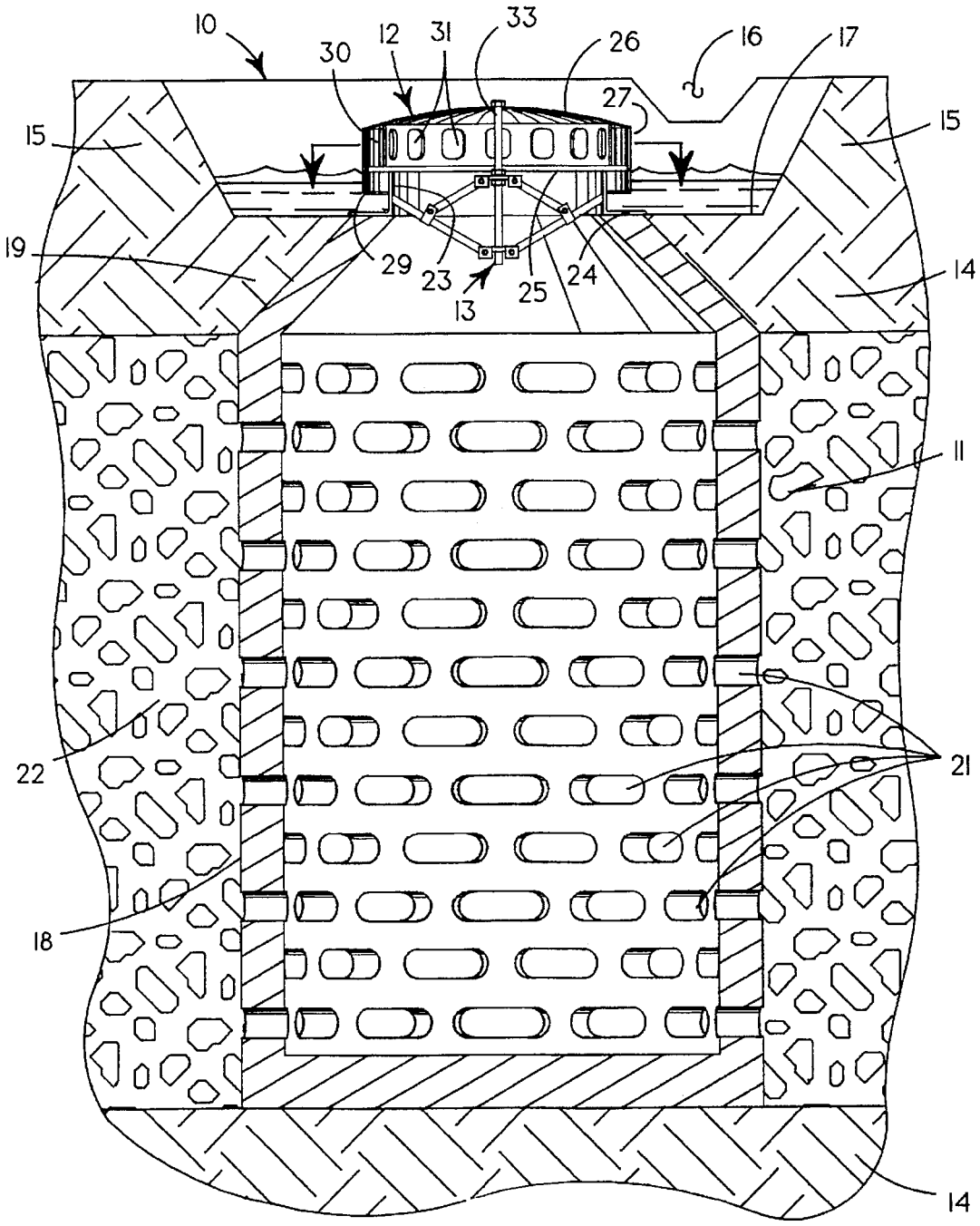
FIG. 1 is a vertical medially cross-sectional view of my skimmer cover in place on a dry well servicing a catch basin showing the various parts of my cover, their configuration and relationship.
Figure 2:
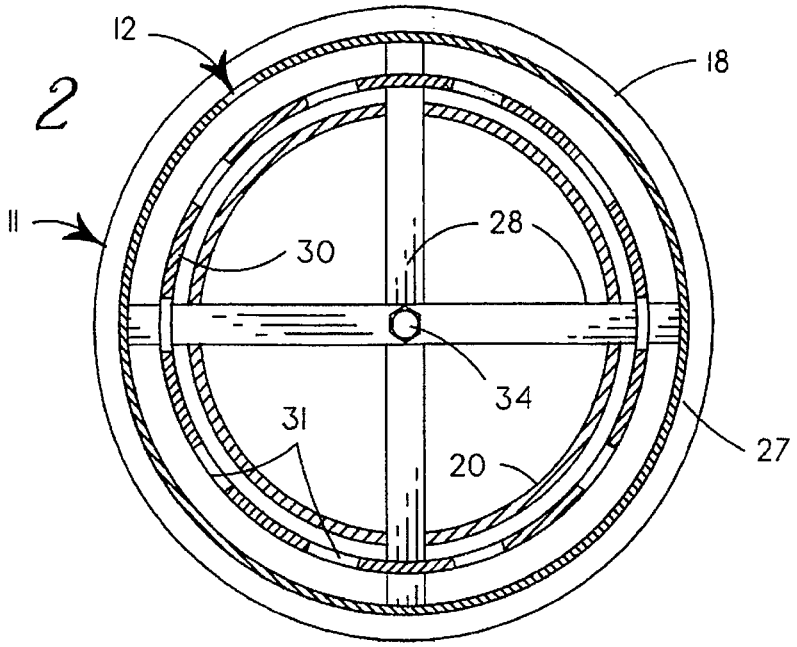
FIG. 2 is a horizontal cross-sectional view through the cover of FIG. 1, taken on the line 2—2 thereon in the direction indicated by the arrows.
Figure 4:
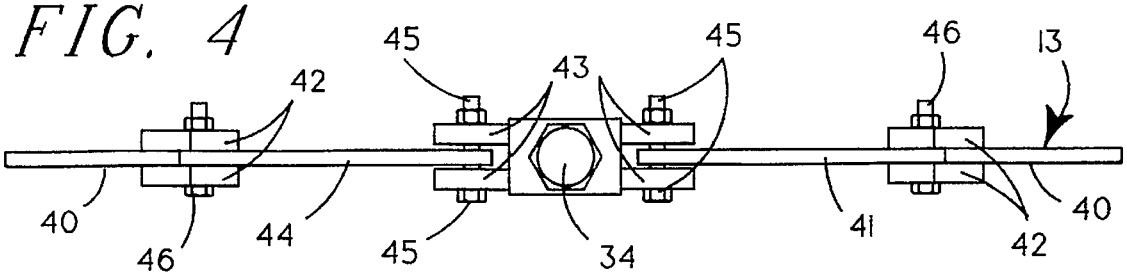
FIG. 4 is a top view of the fastening mechanism of FIG. 3 further showing its construction and details.
Figure 3:
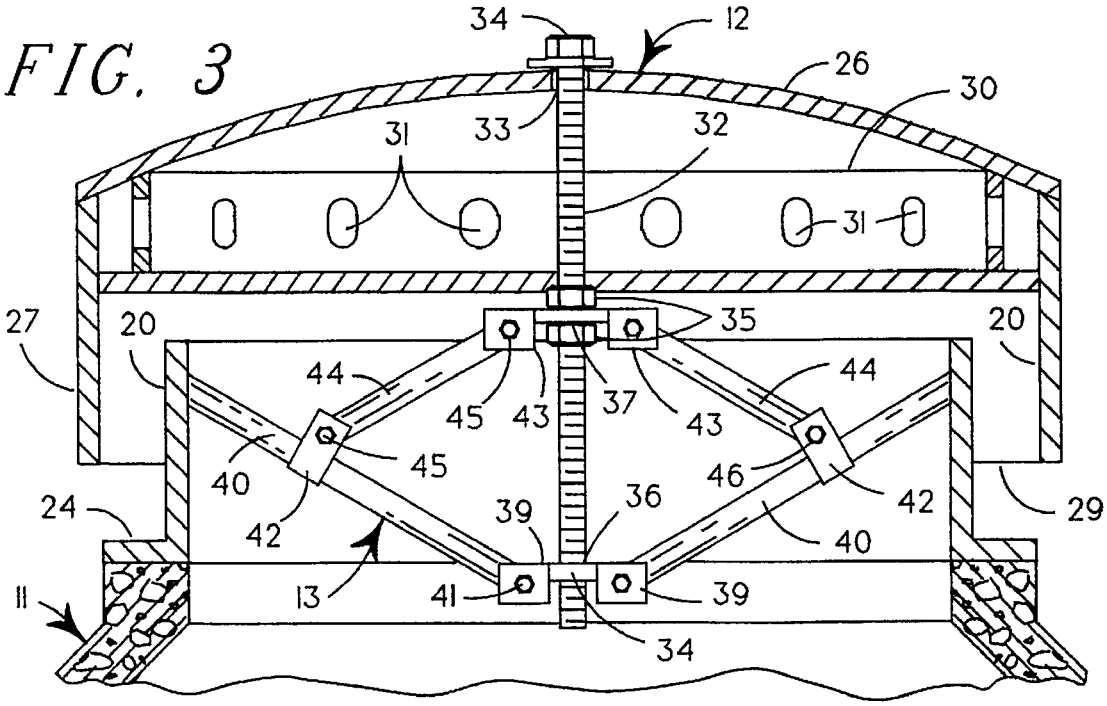
FIG. 3 is a partially cut-away elevational view of the fastening mechanism of my cover.

My invention generally provides skimmer cover 12 having fastening structure 13 for use on the neck of dry well 11 servicing catch basin 10.

The practices of modern land improvement often provide a catch basin 10 formed on the surface of the earth 14 by a peripheral berm 15. Surplus runoff water is introduced into the catch basin by one or more inlets 16 defined in the berm, and the level of water in the system is generally limited by the level of inlets 16, depending upon the local typography. The earth surface defining the bottom 17 of the catch basin normally slopes downwardly to the medially positioned orifice of a dry well 11 or other secondary water disposal system to collect water in that area.

In modern engineering practice, the depth of water in the catch basin may possibly range to several feet above bottom 17, depending upon physical parameters associated with the system, the area serviced by it and the severity of storms that may cause runoff from its serviced area. The primary purpose of the catch basin is to serve as a temporary containment basin or reservoir to receive water and aid dispersement of that water from the catch basin over a period of time. Modern catch basins normally are provided with a cover of vegetative matter on their inner water containing surfaces to aid in entrapping and modifying various environmentally deleterious materials that may be carried into the basin in the normal course of its functioning. In the case of automotive associated hydrocarbons and their residues, modern theory indicates that that material will be contained and absorbed in this vegetative layer where it will be modified to make it less deleterious to the environment, either by subsequent natural deterioration, modification or change, or at least by subsequent dilution.

Some secondary water disposal system such as dry well 11 or a storm sewer drainage system (not shown) is commonly associated with catch basin 10 to aid and make more efficient the dispersement of water therefrom during and after periods of high water input. Dry well 11 traditionally provides tank 18 having truncated conic upper transition portion 19 communicating to diametrically smaller uppermost cylindrical neck 20. A plurality of outflow orifices 21 for dispersement of fluid from the tank into the surrounding environment are defined in the tank sides. Commonly tank 18 is buried in the earth and if so it commonly will be surrounded by permeable material 22 such as crushed rock or similar particulated solids that form passageways between particles to allow relatively free fluid passage therethrough. This secondary drainage system receives water from catch basin 10 for subsequent dispersement into the earth underlying and surrounding the catch basin in a fashion somewhat more efficient than direct dispersement from the catch basin itself, but in general also allows dispersement of any contained floatable materials that are environmentally deleterious directly into the earth's environment.

The uppermost portion of dry well 11 generally provides a cylindrical neck 23, as do most input orifices for storm sewer systems. In the instance illustrated, neck 23 is formed of metal with a lowermost radially outwardly flaring flange 24 structurally attached on the upper surface of transition structure 19 of the dry well, though in other instances this neck may be formed of concrete, plastic or other rigid material and it may be formed as an integral part of the dry well structure rather than as a separate structure mechanically attached thereto. Normally the dry well will be buried in the earth with the top of its transition structure spacedly below the bottom surface 17 of a catch basin being serviced and with the neck 23 projecting spacedly upwardly above that surface 17 in an orientation such as to present a substantially horizontal upper orifice 25.

The reason for this neck positioning is to allow smaller volumes of water carried in the catch basin to remain in that basin and simply permeate into the earth when the water level is not above the upper surface of neck 23, and only allow such waters to enter the dry well 11 through the neck orifice 25 when the volume of water in the catch basin is sufficient to bring its level above the neck orifice. Modern day building and land use regulations and practices often specify a required distance of projection of a neck structure of a dry well or storm sewer drain above the bottom of a catch basin, and this distance when specified is normally in a range of from four to eight inches with an average of about six inches. It is with such a secondary drainage system neck structure or similar storm sewer inlet neck that my skimming cover is used.

Skimmer cover 12 provides solid peripherally defined, preferably dome-shaped, top 26 structurally interconnecting at its periphery depending skirt 27. The peripheral shape of top 26 is preferably similar to the shape of the neck 23 of a dry well to be serviced, and in any event somewhat larger than the external periphery of the neck, so that the skimmer cover may be carried over the neck to extend thereabout. Normally both the neck 20 and skirt 27 will be of circular cylindrical shape, but other cross-sectional configurations are within the ambit and scope of my invention.

The skimmer cover 12 carries in a vertically medial position cross supports 28, in the instance illustrated comprising two elongate metal bars extending in perpendicular diametrical array with coplanar lower surfaces. These supports are carried by and structurally joined to the internal surface of skirt 27 by welding or other similar mechanical fastening. The purpose of the cross supports 28 is to support the skimmer cover on the upper surface of the neck 23 of a serviced secondary water disposal system, and various other supports and support configurations that accomplish this purpose, such as at least two supports extending parallel to each other, three supports extending in a symmetrical radial fashion or other arrays, are within the ambit and scope of my invention.

The vertical positioning of the supports 28 within the skimmer cover is essential to the operation of my invention. The lower edge 29 of skirt 27 must be positioned so that it extends spacedly below the upper edge of neck 23 defining orifice 25, but terminates spacedly above surface 17 defining the bottom of catch basin 10 to allow water in the catch basin to enter the neck orifice from beneath the skirt. Normally the extension of the lower edge 29 of the skirt below the top of neck 23 will be approximately one-half of the extension of the neck above catch basin bottom 17, but this dimensioning is not essential and may be varied according to individual parameters of particular systems.

Cylindrical input baffle 30 is an annular structure of similar cross-sectional shape to skirt 27 that is structurally carried between the lower surface of top 26 and upper surface of cross supports 28. The radial dimension of the baffle is somewhat less than the similar radial dimension of the depending skirt 27 so as to define an annular channel between the two elements. The input baffle defines a plurality of spaced slot-like holes 31 to allow flow of water therethrough and into the orifice 25 of neck 23.

Preferably the various elements of my skimmer cover are formed of sheet metal, normally aluminum or a mild rolled steel, and if so they are preferably structurally joined by welding. It is possible that the cover structure may be formed from resinous or polymeric plastic materials joined by methods known in the plastic manufacturing arts, but such materials may not provide sufficient strength, rigidity and durability for extended use in an exposed environment.

Fastening structure 13 is carried by the skimmer cover 12 to releasably fasten and positionally maintain the cover on the neck 23 of an associated secondary water disposal system. The fastening structure provides threaded fastening rod 32 rotatably carried in medial hole 33 defined in top 26, with rod head 34 above the hole and threaded rod body depending therethrough to a point spacedly below lower edge 29 of skirt 27. The fastening rod 32 carries lower pivot plate 34 and upper pivot plate 35, each defining a medial orifice to receive the rod 32. The orifice 36 in the lower pivot plate is threaded to engage the fastening rod and the orifice 37 in the upper plate is unthreaded and of sufficient size to allow rotatable motion of the fastening rod therein. The upper pivot plate 35 is maintained in a medial position below the cross supports 28 on the fastening rod 32 by lock nuts 38 positioned on each side of the plate in a spaced relationship to allow rotary motion of the rod relative to the plate.

The opposed end portions of lower pivot plate 34 each carry spaced paired fastening brackets 39 defining a channel therebetween to receive the inner end portions of lower fastening arms 40 and mount those arms in a substantially coplanar array. The lower fastening arms 40 each are of a length somewhat greater than the radius of the inside of dry well neck 23 to be serviced by the skimmer cover and are pivotally joined between fastening brackets 39 in their inner end portions by nut-bolt combinations 41 extending between the elements. The medial portions of each lower fastening arm 40 carry similar spaced upper arm fastening brackets 42 extending upwardly therefrom in spaced relationship to pivotally mount upper fastening arms therebetween.

The upper pivot plate 35 at each end carries spaced paired fastening brackets 43 defining a channel therebetween to pivotally receive the radially inner end portions of upper fastening arms 44, which are pivotally mounted between the brackets by nut-bolt combinations 45 extending therethrough. The length of the upper fastening arms 44 is such that they extend to upper arm fastening brackets 42 where they are pivotally mounted by nut-bolt combinations 46. With this fastening structure, as threaded rod 32 is rotated, lower pivot plate 34 will be moved toward or away from upper pivot plate 35 to cause resultant motion of the outer end portions of lower fastening arms 40 away from or toward each other to allow fastening and release of the fastening structure within neck 20.

Having described the structure of my invention, its use may be understood.

A skimmer cover 12 and associated fastening structure 13 are constructed according to the foregoing specification, with parameters determined by known engineering methods for use with a particular catch basin 10 and dry well structure 11 of the type described. The threaded rod 32 of the fastening structure is rotated to move the outer ends of the lower fastening arms 40 radially inwardly toward each other until the distance between them is less than the internal diameter of the neck 23 of a dry well to be serviced. The skimmer cover then is manipulated to position it over the neck 23 of that dry well, with the fastening structure extending downwardly through the orifice 25 defined by the neck and the cover structure resting with its cross supports 28 on the top of the neck. With the cover in this position, the threaded rod 32 is rotated by manipulating its head to cause the outer ends of the lower fastening rods 40 to move radially outwardly away from each other and come into fastenable engagement with the interior surface of the neck 23. As this occurs, the cover will be centered on the neck structure 23, at least along a line passing through the lower fastening arms, and if both the cover and neck are of circular cylindrical configuration the cover will be centered along any diameter. The cover then will be releasably and fastenably maintained in operative position for use.

As water is presented within catch basin 10, it will not pass into dry well 11 so long as its level remains below the level of the orifice 25 defined at the top of neck 23. With such a situation, the water will percolate into the soil underlying the catch basin primarily through the surface 17 defining the bottom of the catch basin or if not, it will in the course of time evaporate into the surrounding atmosphere.

As the water level in the catch basin rises above the lower edge 29 of skirt 27, floatable materials on the surface of water will be maintained outside the cover structure, except possibly for a small amount of such material that may be on the surface of the water between the skirt and dry well neck at the time water rises above the lower edge of the skirt. As the water level in the catch basin rises to the level of the top of the neck 20, the water will begin to flow into the orifice 25 defined by the neck. A flow pattern will be established wherein the water moves from beneath the periphery of the skirt 27 upwardly into the channel defined between the skirt and the dry well neck to pass over the top of the dry well neck and into the dry well.

During this course of flow, so long as the level of water in the catch basin remains above the lower edge of the cover skirt, floatable material of either a fluidic or solid nature will remain above that level and cannot ascend through the channel between the cover and the skirt to be carried into the dry well. When the water level in the catch basin ultimately lowers to and below the lower edge of the cover skirt, no floatable material will pass into the dry well or other secondary disposal system as the water level will be below the upper surface of the neck, and there will be no water flow through the orifice defined by the neck and into the dry well.

The foregoing description of my invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what I desire to protect by Letters Patent, and

What I claimed is:

1. A cover to keep floatable material from entering a drainage system having an input orifice, comprising in combination:

a skimmer cover having a top interconnecting a peripheral skirt, with cross supports carried by the peripheral skirt to support the skimmer cover on the drainage system input orifice with the peripheral skirt depending below the input orifice; and fastening structure, carried by the skimmer cover to depend into the input orifice, having a fastening rod with a head carried above the skimmer cover top and a threaded body depending rotatably through a hole defined in the skimmer cover top and spacedly below the input orifice, a lower pivot plate threadedly carried on a lower portion of the threaded body of the fastening rod, at least two similar upwardly angled lower fastening arms pivotally carried by the lower pivot plate to extend outwardly therefrom, an upper pivot plate rotatably carried and positionally maintained on the threaded body of the fastening rod spacedly above the lower pivot plate, and two similar upper fastening arms, each pivotally depending from the upper fastening plate in coplanar relationship with each lower fastening arm, to to pivotally interconnect with the coplanar lower fastening arm to cause that fastening arm to pivot angularly responsive to rotation of the fastening rod.

2. In a secondary drainage system in a catch basin, having a tubular neck extending spacedly upwardly from the bottom surface of the catch basin to define an input orifice, a cover to keep floatable material from entering the input orifice, comprising in combination:

a cylindrical skimmer cover, having a top defining a medial hole to rotatably carry a fastening rod and structurally interconnecting a depending peripheral skirt carrying cross supports to support the skimmer cover on the neck with the skirt extending spacedly about the neck and below the input orifice defined by the neck to a level spacedly above the bottom surface of the catch basin; and fastening structure carried by the skimmer cover having a fastening rod with a head carried above the the cover top and a threaded body depending through through the medial hole defined in the top and extending spacedly below the input orifice defined by the neck, a lower pivot plate threadedly engaged on a lower portion of the fastening rod and pivotally carrying two angularly upwardly extending, substantially coplanar lower fastening arms having a length to contact the inner surface of the neck of the secondary drainage system, and an upper pivot plate rotatably carried and positionally maintained on the fastening rod above the lower pivot plate, said upper pivot plate pivotally carrying two substantially coplanar upper fastening arms to angularly depend therefrom and pivotally interconnect with the medial portion of the lower fastening arms to cause the lower fastening arms to pivotally move responsive to rotation of the fastening rod.

3. The cover of claim 2 wherein the top member is of a surface of revolution with a dome configuration.

4. The cover of claim 2, having an input baffle of similar cross-sectional shape to the skirt, carried within the periphery of the cover and between the cross supports and the top of the skimmer cover, said input baffle defining a plurality of circumferentially spaced orifices to allow fluid to pass therethrough and into the input orifice defined by the neck.

* * * * *